US005322718A

United States Patent [19]

Low

[11] Patent Number: 5,322,718

[45] Date of Patent: Jun. 21, 1994

[54] PLIABLE PAPERWEIGHT AND ARTICLE HOLDER

[76] Inventor: Elizabeth S. Low, 14441 Memorial Dr., Ste. 12, Houston, Tex. 77079

[21] Appl. No.: 66,520

[22] Filed: May 24, 1993

Related U.S. Application Data

[63] Continuation-in-part of Ser. No. 729,829, Jul. 15, 1991, abandoned.

[51] Int. Cl.[5] ..... B43M 9/00

[52] U.S. Cl. ..... 428/15; D9/314; D19/96; D19/97; 40/358; 446/390

[58] Field of Search ..... 428/15; 446/70, 390, 446/97; D9/314; 40/358; D19/96, 97

[56] References Cited

U.S. PATENT DOCUMENTS

| | | | |
|---|---|---|---|
| D. 85,490 | 11/1931 | Oestreich | D9/314 |
| D. 110,870 | 8/1938 | Lewis | D9/314 |
| D. 252,277 | 7/1979 | Chaires | D19/97 |
| 1,174,068 | 3/1916 | Hincks | 446/70 |
| 2,282,056 | 5/1942 | Hoeflich | 446/209 |
| 2,956,544 | 10/1960 | McDonald et al. | D19/96 X |
| 3,197,786 | 8/1965 | Velonis et al. | 2/167 |
| 3,546,052 | 12/1970 | McNamara | 428/15 |
| 3,885,342 | 5/1975 | Morrison et al. | 446/97 |
| 4,259,806 | 4/1981 | Troll | 428/16 X |

*Primary Examiner*—Henry F. Epstein

*Attorney, Agent, or Firm*—Kenneth A. Roddy

[57] ABSTRACT

A pliable paperweight and article holder having an outer skin of soft flexible material defining an enclosed hollow inner cavity having a central portion and a plurality of hollow generally tubular projections integral therewith extending outwardly from the central portion is completely filled with a mass of shiftable heavy granular material. The shiftable heavy granular material and outer skin of soft flexible material act in cooperation to provide a pliable structure capable of being manipulated to hold and grip various articles. When placed either horizontally of vertically on a surface, the central portion will spread somewhat to conform generally to the surface upon which it is placed, and each of the tubular projections can be manually manipulated or bent to assume various positions as desired for holding various objects or for gripping various objects, and the tubular projections will remain in the desired holding or gripping position. The tubular projections can also be positioned to extend radially outward from the central portion with their outer ends selectively spaced either closely adjacent or spaced apart in selective positions relative to one another. In a preferred embodiment, the pliable paperweight and article holder is in the shape of a human hand, since the utilitarian features of the structure allow it to carry out some of the gripping and holding functions of an actual hand.

1 Claim, 2 Drawing Sheets

PLIABLE PAPERWEIGHT AND ARTICLE HOLDER

CROSS REFERENCE TO RELATED APPLICATION

This application is continuation-in-part of U.S. patent application Ser. No. 07/729,829, field Jul. 15, 1991, now abandoned.

BACKGROUND OF THE INVENTION

1. Field of the Invention

This invention relates generally to paperweights and desk organizers, and more particularly to a pliable paperweight and article holder which can be manually adjusted to assume selective positions for holding various articles.

2. Brief Description of the Prior Art

Paperweights are known in the art which can be placed on papers to hold them down and desk organizers are known for holding pencils, pens, letters, cards, and various other items. Most paperweights are formed as a unitary rigid structure and are incapable of being manually manipulated and adjusted to assume selective positions for engaging various surfaces and for holding various articles.

Oestreich, U.S. Pat. No. Des. 85,490 discloses a bottle formed of rigid material resembling a human hand with all the fingers extending vertically and formed close together as a single unit and has a flat bottom. Oestreich is not a paperweight, is not pliable, does not suggest the structural features of the present invention, and would be incapable of performing the selective utilitarian functions of the present invention.

Chaires, U.S. Pat. No. Des. 252,277 discloses a paperweight and pen holder which is formed of rigid material resembling a human hand with all the fingers close together and formed as a unitary structure with a flat wall at the back end. A drawer or tray having a downwardly curved handle is slidably received in the flat wall. A pin holder extends angularly outward and rearward from the top of the hand. Although the Chaires device is a paperweight, it is not pliable and does not suggest the structural features of the present invention and would be incapable of performing the selective utilitarian functions of the present invention.

The present invention is distinguished over the prior art in general, and these patents in particular by a pliable paperweight and article holder having an outer skin of soft flexible material defining an enclosed hollow inner cavity having a central portion and a plurality of hollow generally tubular projections integral therewith extending outwardly from the central portion which are completely filled with a mass of shiftable heavy granular material. The shiftable heavy granular material and outer skin of soft flexible material act in cooperation to provide a pliable structure capable of being manipulated to hold and grip various articles. When placed either horizontally of vertically on a surface, the central portion will spread somewhat to conform generally to the surface upon which it is placed, and each of the tubular projections can be manually manipulated or bent to assume various positions as desired for holding various objects or for gripping various objects, and the tubular projections will remain in the desired holding or gripping position. The tubular projections can also be positioned to extend radially outward from the central portion with their outer ends selectively spaced either closely adjacent or spaced apart in selective positions relative to one another. In a preferred embodiment, the pliable paperweight and article holder is in the shape of a human hand, since the utilitarian features of the structure allow it to carry out some of the gripping and holding functions of an actual hand.

SUMMARY OF THE INVENTION

It is therefore an object of the present invention to provide a pliable paperweight and article holder which can be manually adjusted to assume selective positions for engaging various surfaces and for holding various articles.

It is another object of this invention to provide a pliable paperweight and article holder which can be placed either horizontally or vertically on a flat surface and will conform substantially to the surface upon which it is placed.

Another object of this invention is to provide a pliable paperweight and article holder having a central portion and a plurality of tubular projections extending outwardly therefrom filled with granular material such that the central portion will spread to conform generally to the surface upon which it is placed and will allow the tubular projections to be manually manipulated or bent to assume various positions as desired, and will remain in desired position for holding various objects or for gripping various objects.

A further object of this invention is to provide a pliable paperweight and article holder which has a distinctive appearance.

A still further object of this invention is to provide a pliable paperweight and article holder which is simple in construction and economical to manufacture.

Other objects of the invention will become apparent from time to time throughout the specification and claims as hereinafter related.

The above noted objects and other objects of the invention are accomplished by a pliable paperweight and article holder having an outer skin of soft flexible material defining an enclosed hollow inner cavity having a central portion and a plurality of hollow generally tubular projections integral therewith extending outwardly from the central portion which are completely filled with a mass of shiftable heavy granular material. The shiftable heavy granular material and outer skin of soft flexible material act in cooperation to provide a pliable structure capable of being manipulated to hold and grip various articles. When placed either horizontally of vertically on a surface, the central portion will spread somewhat to conform generally to the surface upon which it is placed, and each of the tubular projections can be manually manipulated or bent to assume various positions as desired for holding various objects or for gripping various objects, and the tubular projections will remain in the desired holding or gripping position. The tubular projections can also be positioned to extend radially outward from the central portion with their outer ends selectively spaced either closely adjacent or spaced apart in selective positions relative to one another. In a preferred embodiment, the pliable paperweight and article holder is in the shape of a human hand, since the utilitarian features of the structure allow it to carry out some of the gripping and holding functions of an actual hand.

DESCRIPTION OF THE PREFERRED EMBODIMENT

Figure 1:
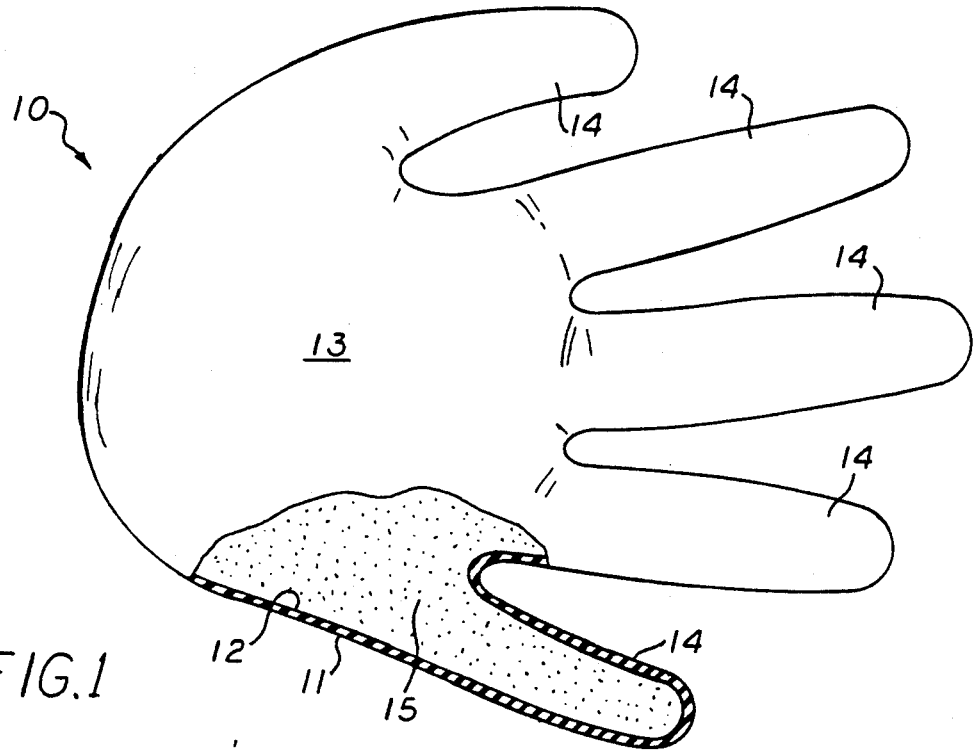
FIG. 1 is a top plan view of a pliable paperweight and article holder in accordance with the present invention.
Figure 2:
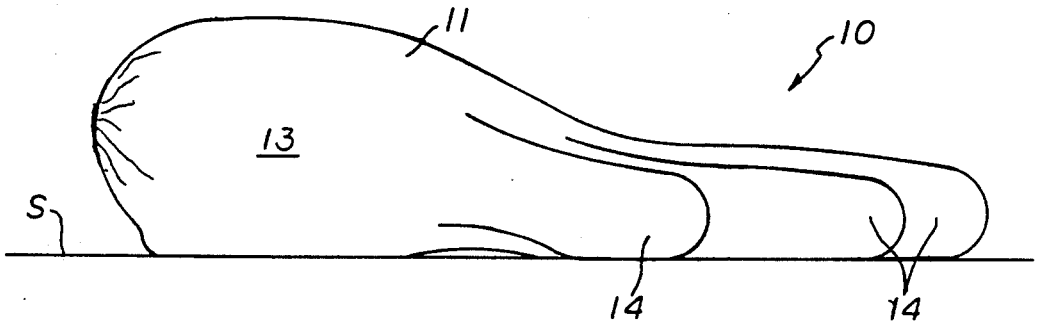
FIG. 2 is a side elevation of the pliable paperweight and article holder shown resting horizontally on a flat surface.
Figure 3:
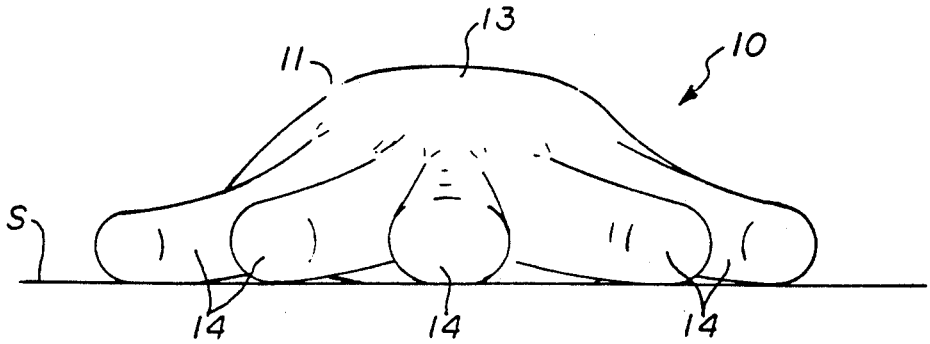
FIG. 3 is an end view of the pliable paperweight and article holder.

Referring to the drawings by numerals of reference, there is shown in FIG. 1, 2, and 3, a preferred pliable paperweight and article holder 10. The pliable paperweight and article holder 10 has an outer layer or skin 11 molded of soft flexible material, such as synthetic rubber (latex or neoprene) or plastic which defines an enclosed hollow inner cavity 12 having a central portion 13 and a plurality of hollow generally tubular projections 14 molded integrally therewith which extend outwardly from the central portion. The tubular projections 14 have rounded ends.

The hollow inner cavity 12 and tubular projections 14 of the outer skin are completely filled with a mass of relatively heavy shiftable granular material 15, such as sand, small pellets, or shot.

The combination of the shiftable granular material 15 and the flexible outer skin 11 provides a pliable construction which will allow the central portion 13 to spread somewhat to conform generally to the surface upon which it is placed and will also allow the tubular projections 14 to be manually manipulated or bent to assume various positions as desired for holding various objects or for gripping various objects, and the tubular projections will remain in the desired holding or gripping position.

For example, FIGS. 2 and 3 show the paperweight and article holder 10 resting horizontally on a flat surface S with the tubular projections 14 extending radially outward from the central portion 13 and spread somewhat apart at their outer ends. The shiftable material 15 and flexible outer skin 11 allows the bottom portion of the central portion 13 and tubular projections 14 to flatten out slightly to conform to the flat surface or other surface upon which it rests. The tubular projections 14 may be placed closer together in a generally parallel configuration or their outer ends may be spread further apart so as to cover more surface area.

Figure 5:
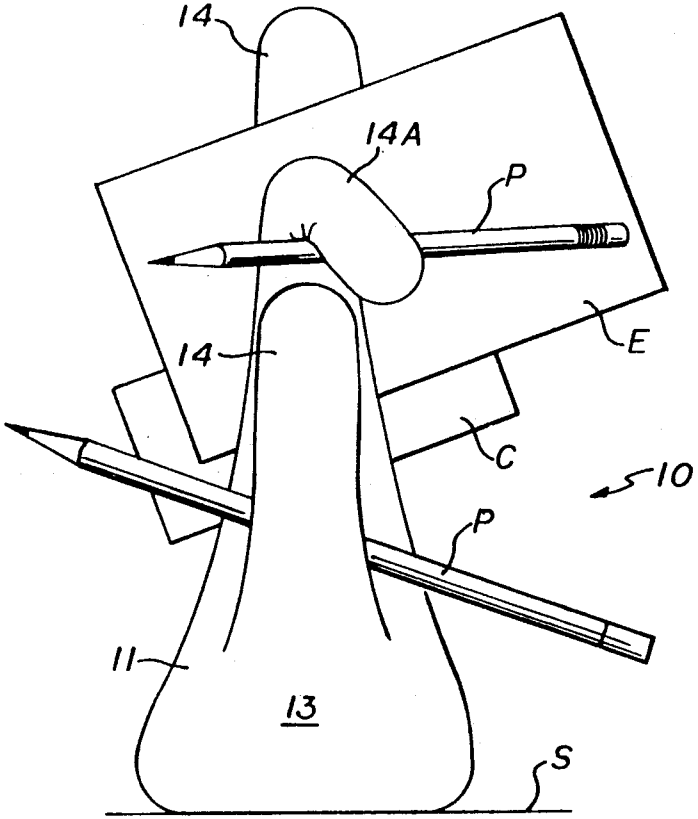
FIG. 5 is a side elevation of the pliable paperweight and article holder shown resting vertically on a flat surface and holding various articles.
Figure 4:
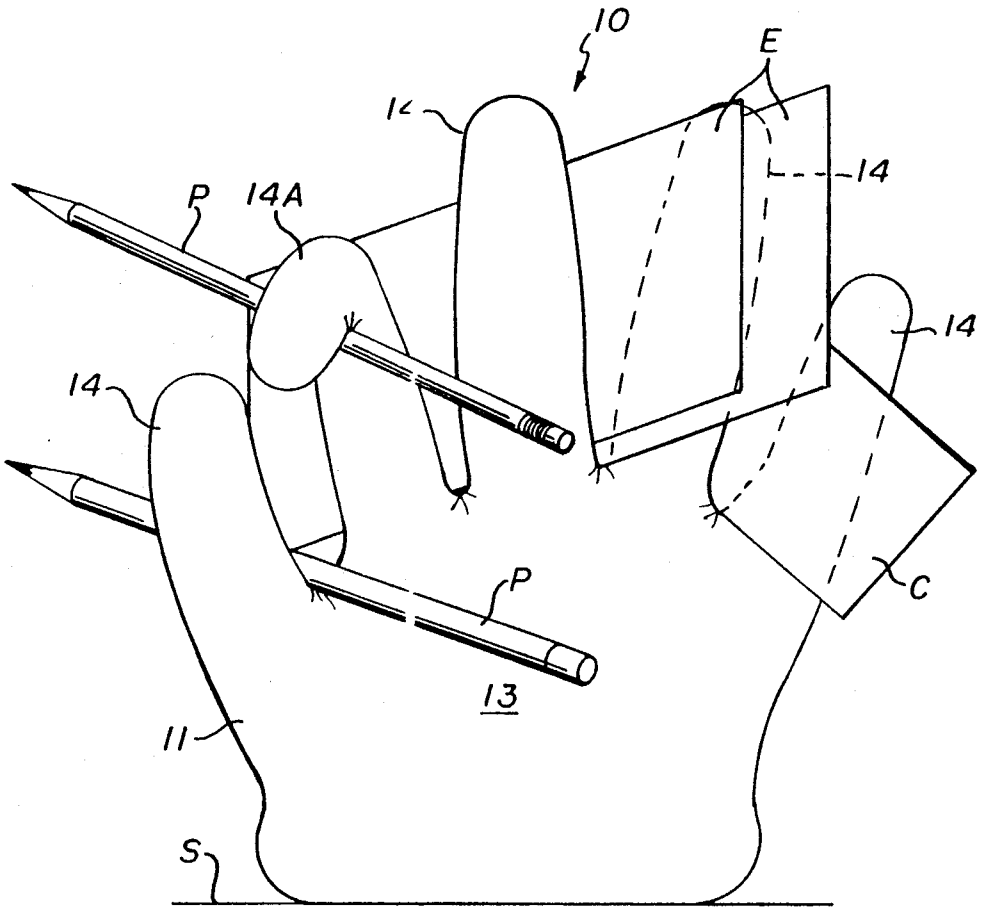
FIG. 4 is a front elevation of the pliable paperweight and article holder shown resting vertically on a flat surface and holding various articles.

The paperweight and article holder 10 may also be positioned vertically on a surface. For example, FIGS. 4 and 5 show the paperweight and article holder 10 resting vertically on a flat surface S with the tubular projections 14 extending upwardly and radially outward from the central portion 13 and spread somewhat apart at their outer ends. The shiftable material 15 and flexible outer skin 11 allows the bottom portion of the central portion 13 to flatten out slightly to conform to the flat surface or other surface upon which it rests. Flat articles, such as envelopes E, cards C, pencils and pens P, eyeglasses (not shown) and various other articles may be placed between the tubular projections 14. The tubular projections 14 may be squeezed closer together to grip the particular article or articles placed between them. Also, as shown in FIGS. 4 and 5, the tubular projections 14 may be bent around an article as indicated at 14A to grip various articles. The tubular projections 14 can also be crossed or overlapped on one another to grip various articles.

It should be understood, that the pliable paperweight and article holder 10 may be provided in various other shapes and designs other than that depicted in the drawings. For example, it may be designed as a human character having arms and legs or as an animal having a plurality of limbs, such as an octopus, etc.

In the preferred embodiment, the pliable paperweight and article holder 10 is in the shape of a human hand, since the utilitarian features of the structure allow it to carry out some of the gripping and holding functions of an actual hand.

While this invention has been described fully and completely with special emphasis upon a preferred embodiment, it should be understood that within the scope of the appended claims the invention may be practiced otherwise than as specifically described herein.

I claim:

1. A pliable paperweight and article holder comprising:

an outer skin of thin soft flexible rubber-like material defining an enclosed hollow inner cavity having a central portion with a plurality of hollow generally tubular pliable projections integral therewith extending radially outward from said central portion and enclosed at their outer ends; and a mass of shiftable heavy granular material completely filling said inner cavity and said tubular projections of said outer skin;

said shiftable heavy granular material and said outer skin of soft flexible material acting in cooperation to provide a pliable structure; and said central portion spreading to conform generally to a surface upon which it is placed, and each of said tubular pliable projections capable of being manually manipulated relative to one another and bent to assume various selective holding or gripping positions to hold or grip various objects with said tubular projections remaining in the selected holding or gripping position after being so manipulated or bent.

* * * * *